United States Patent [19]

Hufenus

[11] Patent Number: 4,690,406

[45] Date of Patent: Sep. 1, 1987

[54] VARIABLE BALANCE RACKET

[76] Inventor: Jean Hufenus, 15A Av. Crebillon 78, 600 Maisons Laffitte, France

[21] Appl. No.: 808,170

[22] Filed: Dec. 12, 1985

[51] Int. Cl.[4] ..... A63B 49/04

[52] U.S. Cl. ..... 273/73 J; 273/73 G

[58] Field of Search ..... 273/73 R, 73 J, 75, 273/73 G, 72 A, 72 R, 26 B, 29 A, 186 R, 186 A, 170, 81 A; 272/128

[56] References Cited

U.S. PATENT DOCUMENTS 3,975,018 8/1976 Walker ..... 273/73 R 4,325,549 4/1982 Vasselli ..... 273/73 R

*Primary Examiner*—Richard C. Pinkham

*Assistant Examiner*—Matthew L. Schneider

*Attorney, Agent, or Firm*—Brisebois & Kruger

[57] ABSTRACT

A variable balance racket has a weight moveable from an inactive or rest position near the grip of the handle to an active position adjacent the head of the racket to increase the striking force of the head. The weight can be moved to the active position and held in this active position by a retainer, against the action of an elastic element which returns the weight to the rest position. The weight is released in response to the centrifugal force of the swing of the racket so it is automatically returned to the rest position before the next swing. This arrangement enables the player to move the weight to the active position prior to a serve or anticipated smash, while returning the weight to the rest position after such a swing for normal play or repositioning in the active position by the player.

7 Claims, 5 Drawing Figures y'
y
x
x'
3a
6a
6
3
10
4a
11
7
12b
12a
4
8a
2b
2a
13b
13a
5
5a
15
1
9a
15a
f1
f2
10b
11a
11b
11c
11d
14a
8a
4a
4
5b
15b
9a
6a
10
6
d
10a
11
7
14b
8b
15
1
9b
15a
11
11a
11c
7a
11d
12a
4
10b
10
10a
4a
7
12b
14b
8b
2a
15
13a
5c
1
4c
16
16a
4b
16b
4a
7
4
d
8a
8c
2b
2a
15
4
8d
8b
4d

VARIABLE BALANCE RACKET

The present invention relates to a playing racket with variable balance, in particular, a tennis racket whose center of gravity, displaced toward the head of the racket before a serve or a smash by means of a moveable element, is automatically returned toward the grip after one of these two movements.

BACKGROUND OF THE INVENTION

Tennis rackets with variable balance are already known which have a device comprised of a moveable element able to slide along a profiled guide disposed between the head or frame of the racket and the end of the handle or "grip" for holding the racket, the moveable element and the guide having means for permitting securing and releasing of the moveable element at appropriate positions on the guide.

According to french patent Nos. 2 235 714 and 2 270 907 the above-mentioned means of the moveable element and the guide cooperate so that the release and displacement of the moveable element from one position to another position on the guide is accomplished by a simple translation force against the moveable element.

However, when the moveable element is placed in a position near the frame to give to a service or a smash an increased force resulting from a counter-balancing or loading called "en tete" (in the head), it is then necessary, if the opponent has returned the service, to bring the moveable element back as rapidly as possible to a position closer to the grip so that the balance of the racket will be more appropriate for the exchange which will follow.

Between the moment of service and that of the return, the player who follows through on his service, therefore has a very short period of time to bring the moveable element back toward the grip, which requires considerable practice not to be a disadvantage during an approach to the net.

SUMMARY OF THE INVENTION

The present invention has as its aim to alleviate this disadvantage by the fact that under the effect of a service or a smash, the moveable element which has previously been immobilized at the base of the frame, automatically returns toward the grip where it is held in a position, to provide this effect.

This result is obtained due to the fact that the moveable element is connected to the grip by an elastic member and, that at the time of a service or a smash, the moveable element is displaced toward the frame under the action of the centrifugal force to which it is subjected, so that it is released from the stop means which were immobilizing it in a position near the frame and thus it is automatically brought back toward the grip by the above-mentioned elastic means.

The invention generally has as its object a tennis racket of variable balance or equilibrium provided with a device comprising a moveable element 7 able to slide the length of a guide 4 between the base of the frame 3 and a location of the grip 1 , and stop means located on the moveable element 7 cooperating with stop means located on the guide 4, in which racket the moveable element 7 is connected to the grip by an elastic element 8*a*,8*b*, the stop means cooperating so that if the moveable element 7 is first immobilized in a location near the base of the frame 3 prior to effecuating the movement of the service or of the smash, the above-mentioned moveable element is then automatically released and displaced first toward the frame by the centrifugal force to which it is subjected at the time of the service or of the smash, and is then brought back under the return effect of the above-mentioned elastic element, to a location closer to the grip.

The moveable element 7 is connected by the elastic element 8*a*,8*b*, preferably to the end 9*a*,9*b* of the grip furthest from the base of the frame 3 and is able to slide the length of the guide 4 from the grip to the base of the frame, under the action of a translation force f1, while being subjected to an increasing elastic tension.

Preferably the guide 4 is a shaped piece having one flat surface 4*a* parallel to the plane of the strings 3*a*, and which has, at a small distance "d" from its end which is fastened to the base of the frame 3, a stop means 10 capable of cooperating with a stop means 11 of the moveable element 7, and the elastic element 8*a*,8*b* fixed to the moveable element extends into the hollow portion 15*b* of the grip through openings 8*c*,8*d* in the front wall 15 of the grip.

The following non-limiting examples illustrated by FIGS. 1 to 5 will allow the object of the invention to be better understood.

DETAILED DESCRIPTION OF PREFERRED EMBODIMENTS

Figures 1, 2, 3, 4, 5:
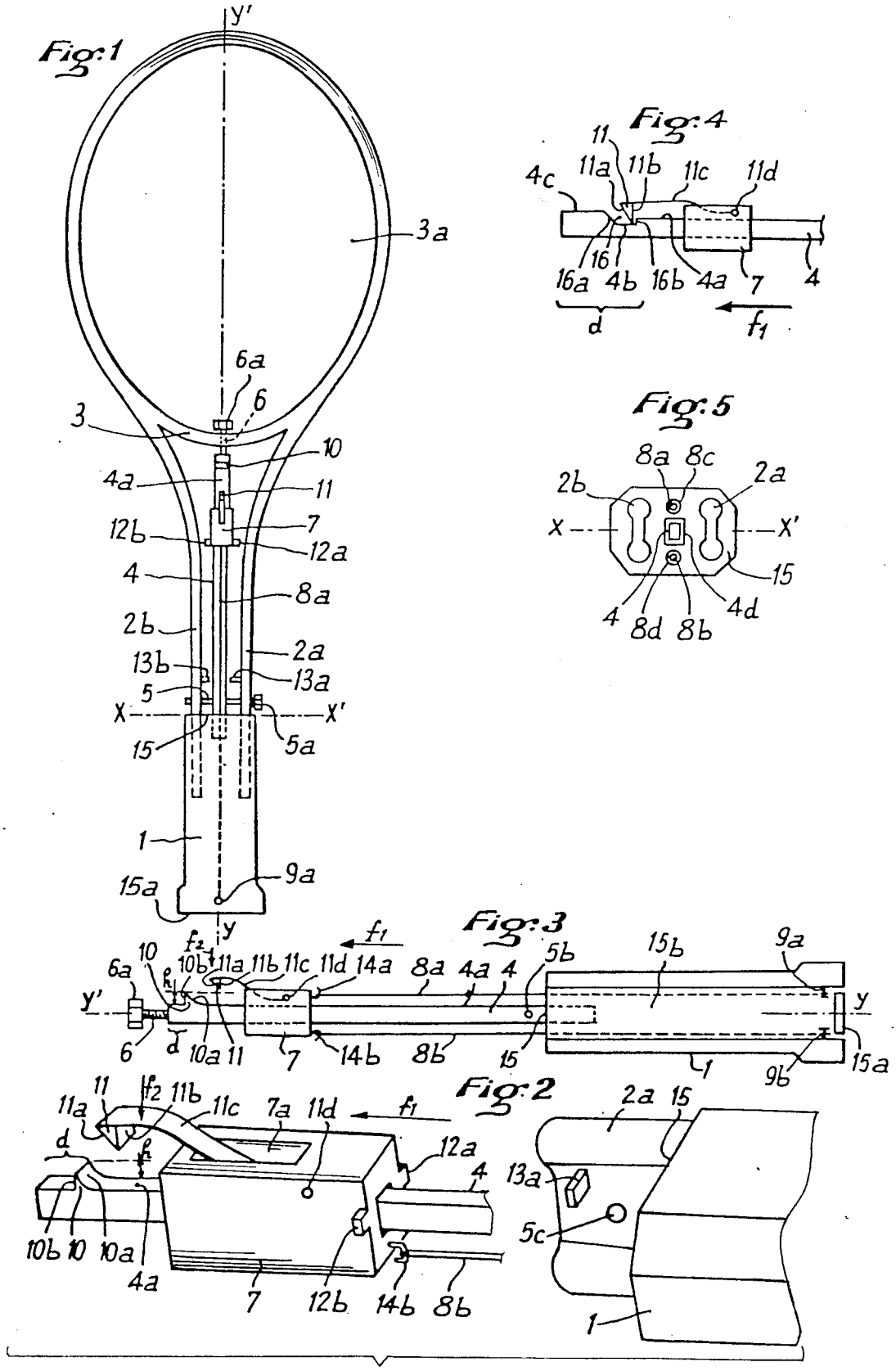
FIG. 1 shows according to the plane of the strings, a racket of the invention of the "branched" type.
FIG. 2 shows, in a broken perspective view, a first embodiment of the device of the racket of the invention.
FIG. 3 shows, in a section along axis YY' and perpendicular to the plane of the strings, the device of FIGS. 1 and 2.
FIG. 4 shows, partially and along the section of FIG. 3, a second embodiment of the device of the racket of the invention.
FIG. 5 shows in a section along axis XX' and perpendicular to the plane of the strings, the device of FIGS. 1, 2, and 3, extending through the front wall of the grip.

The racket shown on FIG. 1 comprises a grip 1 which is axially hollow, arms 2*a*,2*b*, a frame 3, strings 3*a*, a guide 4, a surface 4*a* of the guide parallel to the plane of the strings, a fastening means 5 for the guide 4, near the grip and traversing the arms 2*a*,2*b*, an end 5*a* for screwing or gripping the fastening means 5, a securing means 6 for guide 4 to traverse through the base of the frame, an end 6*a* for screwing or gripping the above-mentioned means 6, a moveable element 7, a part of the elastic means 8*a* fixed on the one hand to the moveable element 7 and on the other hand to the grip by fastening means 9*a*, stop means 10 of the surface 4*a* of the guide near the base of the frame, stop means 11 of the moveable element cooperable with the above-mentioned stop means 10, means 12*a*, 12*b* of the moveable element cooperating with means 13*a*,13*b* on the arms 2*a*,2*b*, mentioned above, to keep the moveable element near the grip during the exchanges following the service or smash.

The broken view shown at FIG. 2 comprises the grip 1, a front wall 15 of the grip facing toward the frame, the arm 2*a*, the guide 4 of rectangular section on which moveable element 7 can slide and which is attached to the grip by the elastic element 8*b* fastened on the one hand to the moveable element at 14*b* and on the other hand to the grip at a location 9b not shown. The surface 4a of the guide, parallel to the plane of the strings, has a stop means in the form of a catch 10 whose surface 10b which faces toward the strings is perpendicular to the surface 4a mentioned above, and the surface 10a which faces toward the moveable element is in the extension of the surface 4a and according to an inclined contour; the above-mentioned catch having a height "h" with respect to the surface 4a, and the surface 10a being located at a distance "d" from the end of the guide fastened to the frame.

The moveable element 7 has a spring assembly 11c positioned in an opening 7a, fastened around a pin 11d, and terminating in a stop means in the form of a latch 11, facing toward the guide. The surface 11b of the above-mentioned latch faces toward the grip and is perpendicular to the surface 4a of the guide, and the surface 11a faces toward the strings and forms an inclined portion of the latch 11.

The arrow f1 shows the direction of the translation force exerted on the moveable element to displace it toward the frame, and the arrow f2 the pressure exerted on the spring assembly 11c seated in the opening 7a, so that the surface 11b of the latch 11 is placed in contact with the surface 10b of the catch 10 when the latch 11 passes beyond the opposed catch 10, toward the frame. The surface 11b is then held against the surface 10b under the action of the tension of the elastic means 8a,8b of which the part 8a symmetrical with the part 8b is not shown on the drawing.

The moveable element 7 has rigid lugs 12a, 12b and the arms 2a, 2b have flexible means 13a, 13b near the grip, allowing by flexing, the above-mentioned lugs to pass when the moveable element 7 is returned toward the base of the grip after a service or a smash. The above-mentioned flexible means then exert a sufficient holding force on the above-mentioned lugs to keep the moveable element near the front wall 15 of the grip during the exchanges following the service or the smash. The opening 5c through which the fastening means 5 passes is shown on the arm 2a.

The device shown on FIG. 3 includes the grip 1, the guide 4 extending through the front wall 15 of the grip, which faces toward the strings, into the axial portion 15b of the grip which is hollow along its entire length up to the closure element 15a, the surface 4a of the guide, the hole 5b of the guide through which the fastening means 5 passess, the above-mentioned fastening means 6 and its end 6a, the moveable element 7, the elastic means 8a, 8b, the fastening means 9a, 9b to the grip, and 14a, 14b to the moveable element, the catch 10 of the guide and its above-mentioned surfaces 10a and 10b as well as the opposing latch 11 of the moveable element with its surfaces 11a and 11b ending the spring assembly 11c fastened to the moveable element around the pin 11d, and the indication of the height "h", and the distance "d" mentioned above.

Stated more precisely, the latch 11 of the moveable element 7 has a first position in which it is at a distance greater than "h" from the surface 4a of the guide 4, and a second position in which it is at a distance less than "h" from the surface 4a of the guide 4, movement from the first to the second position being accomplished by pressure f2 exerted on the spring 11c connected to the latch 11, and conversely the movement from the second to the first position is due to an opposite effect of the spring 11c just sufficient to return the latch 11 to it first position, when the above-mentioned pressure is eliminated.

The immobilization of the moveable element 7 on the guide 4 is obtained by the combination:

(1) of the translation force f1 exerted on the moveable element 7 until the surface 11b of the latch 11 is at a distance less than "d" from the end of the guide 4;

(2) of the pressure f2 exerted on the spring 11c to bring the latch 11 to the second position mentioned above; and (3) of the tension of the elastic element 8a,8b pressing the surface 11b against the surface 10b.

The release of the moveable element 7 is accomplished by the fact that, on the one hand, the above-mentioned elastic tension while sufficient to hold the moveable element against the guide before the service or smash, is enough lower than the centrifugal force exerted on the moveable element 7 because of the speed imparted to the racket during the service or the smash, and that, on the other hand, the above-mentioned distance "d" is great enough to allow successively the release of the moveable element 7 under the effect of the above-mentioned centrifugal force followed by its return to a location nearer the grip.

In the starting position, that is, before the racket is armed for the service or smash, the moveable element is located at a position near the grip, the projections 12a,12b being between the flexible means 13a,13b and the front wall 15 of the grip.

To arm the racket, the player exerts a translation force on the moveable element for the length of the guide in the direction of the frame and also exerts a pressure on the spring 11c at the end of the course when the latch 11 of the moveable element goes beyond the location of the catch 10 of the guide. The player can then stop the translation movement while maintaining the pressure according to f2, so that the moveable element is subjected to the tension of the elastic element and the surface 11b presses against the surface 10b, which has the effect of imobilizing the moveable element.

The player can also combine the pressure f2 with the force f1 so that at the end of the course of the moveable element the surface 11a slides along the surface 10a, before the latch 11 engages on the catch 10.

During the service or the smash, the racket is subjected to an increasing centrifugal force, especially the moveable element which, when this centrifugal force is greater than the force of the tension of the elastic element 8a,8b, moves toward the frame, releasing the latch, whose surface 11b is then no longer held against the surface 10b. Under the effect of the leaf spring 11c the latch 11 is disengaged from the catch 10, returning to the first position mentioned above, and the moveable element is brought back toward the grip by the elastic element 8a,8b whose tension is adjusted so that it is still great enough that the flexible means 13a,13b allow the lugs 12a,12b of the moveable element to pass. In other words, the force of tension of the elastic element 8a,8b must be:

strong enough, on the one hand, before the service to keep the latch of the moveable element and the catch of the guiding element engaged in spite of the effect of the spring 11c, and on the other hand, after the service to bring the moveable element back toward the grip causing the lugs 12a,12b to pass between the flexible means 13a,13b and the grip; but weak enough to allow, at the time of service, disengagement of the catches of the moveable element and the guiding element under the effect of the centrifugal force, the distance "d" being great enough to allow the disengagement of the moveable element and the return of the spring 11*c* to its first position.

The surface 10*b* must form with the plane of the strings an angle equal to or less than 90° so that the catches 11 and 10 can couple.

In general, any system producing the same results in immobilizing and releasing the catches 10 and 11 of FIG. 3 could be used in the racket of the invention.

The arrangement of FIG. 4 comprises stop means of the guide 4 formed at the end of the surface 4*a* by a notch 16 successively including a flat part 16*b* forming toward the frame, with the plane of the strings 3*a*, an angle not exceeding 90° and located at the distance "d" from the end of the guide, a surface 4*b* below the surface 4*a* and parallel thereto, an inclined part 16*a* forming an obtuse angle with the surface 4*a*, toward the grip, and a surface 4*c* above the surface 4*a* and parallel to this latter, the stop means 11 of the moveable element having the shape of a latch directed toward the guide and whose part 11*b* facing toward the grip can cooperate with the above-mentioned part 16*b*, the above-mentioned latch being connected to the moveable element 7 by the spring assembly 11*c*, just sufficient to hold the latch against the surface 4*a* and then to cause the engagement of the latch in the above-mentioned notch.

The immobilization of the moveable element 7 on the guide 4 is achieved by the combination:

(1) of the translation force f1 exerted on the moveable element 7 until the engagement of the latch 11 in the notch 16, parts 11*b* and 16*b* being in contact; and (2) of the tension of the elastic means 8*a*,8*b*.

The release of the moveable element is achieved by the fact that , on the one hand, the above-mentioned elastic tension is enough less than the centrifugal force to which the moveable element 7 is subjected because of the speed imparted to the racket during the service or the smash, and that, on the other hand, the above-mentioned distance "d" is sufficient in view of the spring 11*c* and the configuration of the surfaces 4*b*, 16*a*,4*c* of the notch 16, to allow the disengagement of the moveable element 7 under the effect of the centrifugal force and its return toward a position nearer the grip under the effect of the tension of the above-mentioned elastic means.

To arm the racket, the player exerts a translation force on the moveable element, the length of the guide, from its starting position as in FIG. 3 until the latch of thej moveable element which is held against the surface 4*a* under the effect of the spring 11*c* then automatically engages in the notch 16 still under the effect of the above-mentioned spring.

At the time of service, the racket is subjected to an increasing centrifugal force, expecially the moveable element which, when this centrifugal force is greater than the tension force of the elastic element 8*a*,8*b*, moves toward the frame, releasing the latch 11 whose surface 11*b* is no longer held against the surface 16*b* of the slot 16. The tension of the elastic element is so adjusted that, under the effect of the increasing centrifugal force, the latch 11 of the moveable element moves successively against the surfaces 4*b*, 16*a*,4*c* in the direction of the frame 3 over such a distance of the surface 4*c* that, when the centrifugal force decreases at the end of service, the return speed imparted to the moveable element will be great enough, in view of the effect of the spring 11*c*, the difference in level between the surfaces 4*c* and 4*a*, so that the latch 11 will no longer be held by the notch 16; the moveable element then being brought back toward the grip as shown in the case of FIG. 3.

In other words, the force of the tension of the elastic element 8*a*,8*b* must be:

strong enough on the one hand before the service to keep the latch of the moveable element engaged in the notch of the guide, and on the other hand, after the service when the centrifugal force decreases to allow the catch 11 to pass from contact with the surface 4*c* into contact with the surface 4*a* avoiding the notch 16 in view of the sufficiently weak effect of the spring 11*c*, the moveable element then being brought back toward the grip by causing the lugs 12*a*,12*b* to pass between the flexible means 13*a*,13*b* and the grip; but this force of tension must be:

weak enough to allow, during service, when the centrifugal force is increasing, displacement of the latch 11 toward the frame over such a distance of the surface 4*c* that the return speed of the elastic element will be sufficient for latch 11 to avoid the notch 16 as indicated above.

In general any system producing the same results of immobilization, then of release, as those obtained with the latch 11 and the notch 16 according to FIG. 4, could be used in the racket of the invention.

FIG. 5 shows the sections of the arms 2*a*,2*b*, of the guide 4 and of the opening 4*d* through which the guide traverses the wall 15 of the grip, the sections of the elastic means 8*a*,8*b*, and of the respective openings 8*c*,8*d* through which these means traverse the above-mentioned wall 15.

In brief and as shown above, the invention concerns a racket of variable balance or equilibrium having an automatic release system for the moveable element previously immobilized in a position near the frame on the guide, the system being based on the fact that, during the service or the smash, the centrifugal force imposed on the moveable element increases until it attains, at the moment of impact with the ball, a value such that the means to hold the moveable element no longer operates; the centrifugal force then diminishes until the end of the movement of service or smash so that the released moveable element is brought back toward the grip by an elastic element whose tension is opposite to the centrifugal force.

The preferred arrangements of the invention are shown in detail at FIGS. 2 to 5, but any other system which immobilizes the moveable element before the service or the smash, then releases it at the moment of impact so that it can be brought back toward the grip by an elastic element can be used according to the invention.

The moveable element and the guide are known from the prior art, particularly from French patent Nos. 2,235,714 and 2,270,907. However, the moveable element of the invention also includes, fastened on the pin 11*d*, the spring 11*c* terminating in the latch 11 able to move in the slot 7*a* perpendicularly to the guide, the fastening means 14*a*,14*b* for the elastic element 8*a*,8*b*, and the projections 12*a*, 12*b*.

Any other spring system other than the leaf 11*c* and the pin 11*d* can be used according to the invention. The above-mentioned leaf spring can in particular be of steel or any other elastic material whatever, and the elastic system can be a composite system including rigid elements and elastic elements. The fastening means 14*a*,14*b* can be constituted of hooks or any other equivalent means. The rigid projections 12*a*, 12*b* can be located at any point of the moveable element provided that they cooperate with the flexible means 13*a*,13*b* on the arms 2*a*,2*b*, as shown at FIGS. 1 and 2; it being understood that the moveable element can support the flexible means and then the above-mentioned arms support the rigid projections.

The elastic element 8*a*,8*b* is preferably formed of at lest two parts fastened to the moveable element and to the grip, respectively on either side of the axis of the guide. It is constituted of an elastomer, a metalic spring of the coil type or a composite system with the understanding that its elasticity is sufficient to allow the moveable element to which it is attached to slide along the guide from the position in which it is held by the flexible means 13*a*,13*b* up to the stop means 10, so that the centrifugal force can release the moveable element by its displacement toward the frame, and so that the above-mentioned rigid projections can pass to the space between the flexible means 13*a*,13*b* and the wall 15 of the grip during the return of the moveable element toward the grip.

The device of the invention can be integrated with the racket. It can also be detachable, the guide being fastened on the one hand to the frame by the knurled head screw 6*a* and on the other hand to the grip through the opening 4*d* of the wall 15 of the grip and by the knurled head screw 5*a* through the arms 2*a*,2*b* , and the hole 5*b* of the guide element; the above-mentioned fastening means also being able to be replaced by equivalent means.

Finally, the racket of the invention, having the center of gravity automatically displaceed toward the grip after the service or the smash, is a racket of metal or of any other material, but which has between the frame and the grip, a free axial space in which a guide is placed on which a moveable weight element can move, the grip being axially hollow, in such a way as to provide a passage, especially for the elastic element 8*a*,8*b* and the guiding element.

I claim:

1. A variable balance tennis racket comprising, an annular head adapted to receive strings, an elongated handle connected to and extending from a base portion of said head, a grip on said handle adjacent an end of the handle remote from the head, a weight element, means mounting said weight element for movement between a first position spaced from the base portion of the head in a direction toward the grip, and a second position adjacent the base portion of the head, elastic means for returning said weight element from said second position to said first position, retaining means for retaining said weight element in said second position, against the return action of said elastic means, upon movement of the weight element to the second position, and means for releasing said weight element from said retaining means in response to centrifugal force of a swing of the racket so that the weight element is returned to said first position by said elastic means after a forceful swing of the racket.

2. A variable balance tennis racket according to claim 1 wherein, said elastic means comprises an elastic element which extends through the grip and is connected to the end of the handle remote from the base portion of the head.

3. A variable balance tennis racket according to claim 1 wherein, said means mounting said weight element for movement between said first and second positions comprises, an elongated guide extending between the base portion of the head and the grip of the handle.

4. A variable balance tennis racket according to claim 3 wherein, said elongated guide includes a flat side surface parallel to the plane of the annular head, said retaining means comprises a catch shoulder on said side surface and a cooperating latch connected to said weight element, said catch shoulder facing toward the head and said latch facing away from the head for engagement with said shoulder, to latch the weight in said second position.

5. A variable balance tennis racket according to claim 4 wherein, said catch shoulder and latch engage and cooperate in said second position of said weight, to retain said weight in a position spaced slightly spaced from said head, so that the weight can move toward the head, under the action of the centrifugal force, a distance sufficient to disengage said catch shoulder from said latch, to enable the elastic means to return the weight to the first position.

6. A variable balance tennis racket according to claim 5 wherein, a spring connects said latch to said weight, said spring exerting a force on said latch insufficient to release said latch from said catch shoulder while said elastic means urges the latch into engagement with the shoulder, but sufficient to move the latch outwardly of the shoulder upon movement of the weight toward the head, under the action of the centrifugal force.

7. A variable balance tennis racket according to claim 4 wherein the catch shoulder of the guide which faces toward the head comprises a flat surface forming an angle not exceeding 90° with the plane of the annular head, and the latch of the moveable element has a surface facing away from the head for engagement with the catch shoulder.

* * * * *